United States Patent [19]

Pessis

[11] Patent Number: 4,998,315

[45] Date of Patent: Mar. 12, 1991

[54] NAIL POLISH BRUSH

[76] Inventor: Barbara A. Pessis, 1245 W. Laurel Ave., Apt. 14, Los Angeles, Calif. 90046

[21] Appl. No.: 464,392

[22] Filed: Jan. 12, 1990

Related U.S. Application Data

[63] Continuation-in-part of Ser. No. 162,661, Mar. 1, 1988.

[51] Int. Cl.[5] ..... A46B 9/00

[52] U.S. Cl. ..... 15/160; 15/167.3; 132/320; D28/7

[58] Field of Search ..... D7/130, 132, 135; D28/4, 7, 56, 59; 15/160, 167.1, 167.3

[56] References Cited

U.S. PATENT DOCUMENTS

D. 116,066 8/1939 Twomey ..... D7/130
D. 197,044 12/1963 Dutch ..... D28/7

FOREIGN PATENT DOCUMENTS 468153 9/1950 Canada ..... 132/320
3538653 5/1987 Fed. Rep. of Germany ..... 132/320
1242317 8/1960 France ..... 15/167.3
11253 of 1907 United Kingdom ..... 15/167.3

*Primary Examiner*—Harvey C. Hornsby
*Assistant Examiner*—Pat Brinson
*Attorney, Agent, or Firm*—Jack C. Munro

[57] ABSTRACT

A tapered and contoured brush for applying fluid materials such as nail polish to nail surfaces of a user is described. The bristle body of the present invention is fixed to a handle which may be integrally connected to a container cap. The bristle body is comprised of proximate, distal, superior, and inferior edges, the latter being tapered to minimize undesirable application of polish to surrounding cuticle surfaces to eliminate cuticle trauma and also to prevent accumulation of polish on the proximate edge of the bristle body. The bristles of the bristle body are contoured to the shape of users' nails and comprise a bristle body of greater width than prior art brushes in order to provide a more uniform and quick application. In addition, the bristles readily bend and yield laterally to prevent the streaking effect commonly exhibited by prior art brushes. The inferior surface is to include a ledge to enhance the application of the nail polish.

6 Claims, 2 Drawing Sheets

NAIL POLISH BRUSH

REFERENCE TO PRIOR APPLICATION

This application is a Continuation-in-Part of U.S. patent application Ser. No. 162,661, filed Mar. 1, 1988, by the same inventor and by the same title.

BACKGROUND OF THE INVENTION

The field of this invention relates to cosmetics and more particularly to an apparatus for applying fluid materials such as nail polish to finger and toe nail surfaces of a human being.

In today's society a high regard is placed on proper grooming techniques. One aspect of personal appearance is adequate finger and toe nail care. It has been considered particularly desirable to apply colored and transparent polish to these nail surfaces for purposes of strengthening, protecting, and/or embellishing.

The most common method of applying polish to nail surfaces is by utilizing a brush. Presently, the most widely used brush comprises semi-rigid bristles of equal length, composite thickness and width, a handle to which the bristles are affixed, and a closure mechanism. A particularly undesirable result of such prior art brushes is the accumulation of polish on the bristles. This accumulation ultimately causes destruction of the bristles and results in an uneven paint coating of the nails. Another disadvantage of the typical brush is the user's inability to prevent the application of polish to the cuticles surrounding the nails, also a result from the bristles being uniform in length thickness and width.

A portion of the problem may be eliminated by shortening the bristles closest to the cuticle surfaces as shown in U.S. Pat. No. 2,475,645. However, the problem of accumulation of polish at the base of the nail and at the cuticle are still present.

SUMMARY OF THE INVENTION

A tapered and contoured brush for applying fluid materials such as nail polish to nail surfaces. The bristle end of the brush is mounted to a handle which may be integrally connected to a container cap. The bristle end is comprised of proximate, distal, side, superior, and inferior edges, the latter being tapered to minimize undesirable application of polish to surrounding cuticle surfaces and eliminate cuticle trauma. The bristles are contoured to the shape of the user's nails and comprise a bristle body of greater width than prior art brushes in order to provide a uniform and quick application in a single stroke of the brush. In addition, the bristles readily bend and yield laterally to prevent the streaking effect commonly exhibited by brushes currently available on the market. The brush of the present invention may be provided with a concavely curved inferior surface which is to enhance the application precision of nail polish treatment. This precision further adds to the embellishment of the user when utilizing the brush of the present invention. The inferior surface is to also include a ledge.

It is an object of the present invention to provide a brush in which accumulation is minimized of liquid on the bristles and nail surfaces.

It is another object of the present invention to provide a brush which enables the user to apply polish to the nail surface more evenly and quickly.

It is yet another object of the present invention to provide a brush with flexible bristles which readily yield laterally to prevent streaking of the polish as it is applied.

It is another object of the present invention to provide a brush which provides uniform application of polish application entirely across the surface of the nail.

DETAILED DESCRIPTION OF THE SHOWN EMBODIMENT

Figure 1:
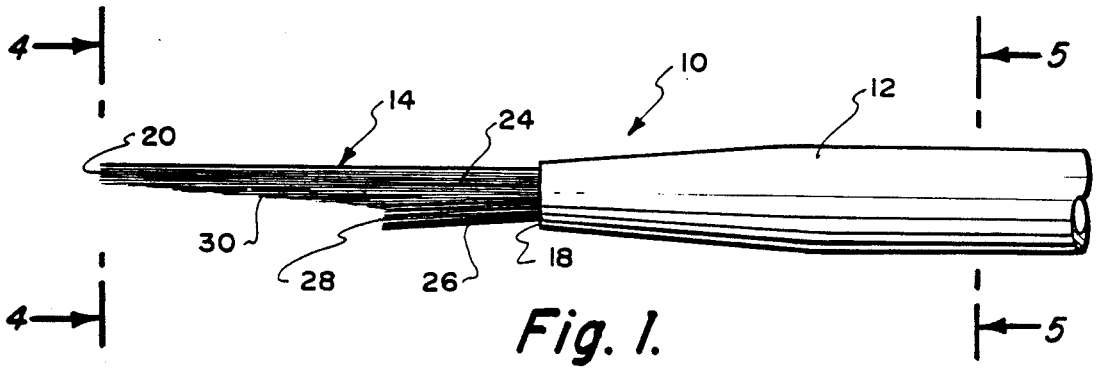
FIG. 1 is a side elevational view of the first V embodiment of an improved nail polish brush of the present invention.
Figure 2:
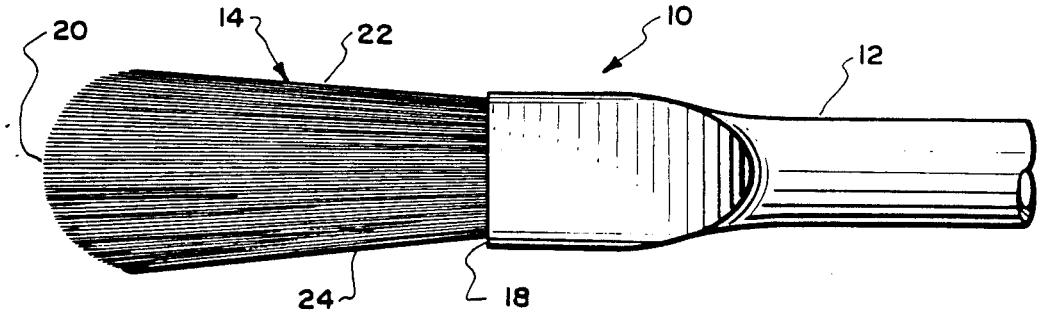
FIG. 2 is a top plan view of the improved nail polish brush of FIG. 1.
Figure 3:
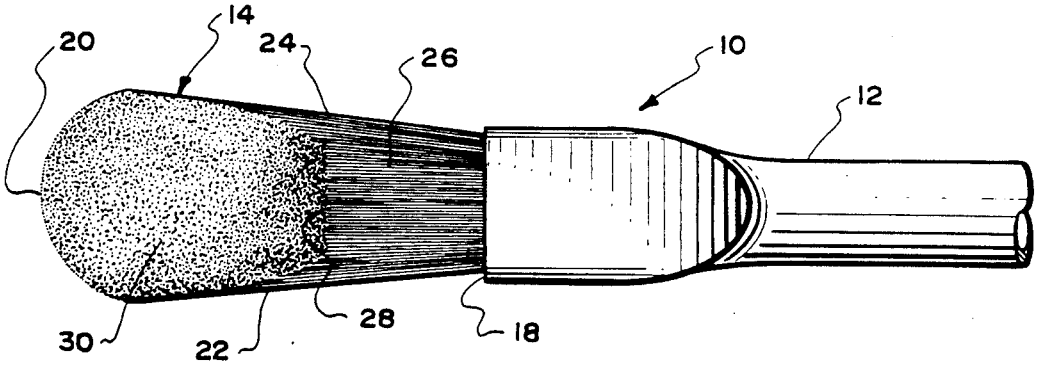
FIG. 3 is a bottom plan view of the improved nail polish brush of the first embodiment of this invention.
Figure 4:
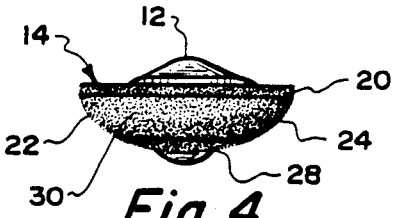
FIG. 4 is a front end view of the first embodiment of the improved nail polish brush of this invention taken along line 4—4 of FIG. 1.
Figure 5:
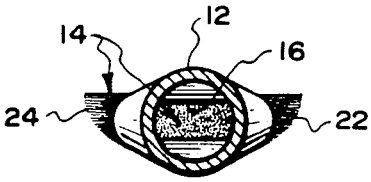
FIG. 5 is a cross-sectional view through the handle of the improved nail polish brush of the present invention taken along line 5—5 of FIG. 1.
Figure 6:
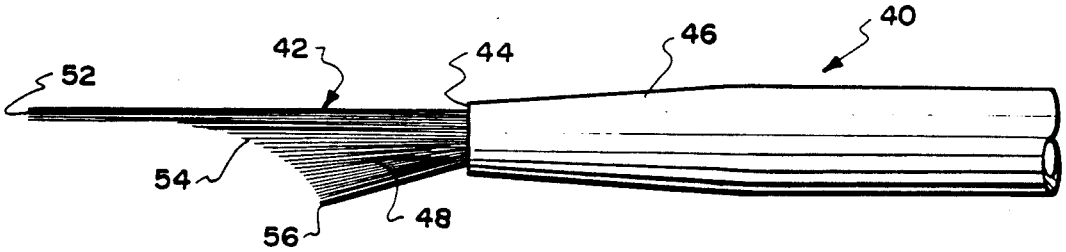
FIG. 6 is a side elevational view of the second embodiment of the improved nail polish brush of the present invention.
Figure 7:
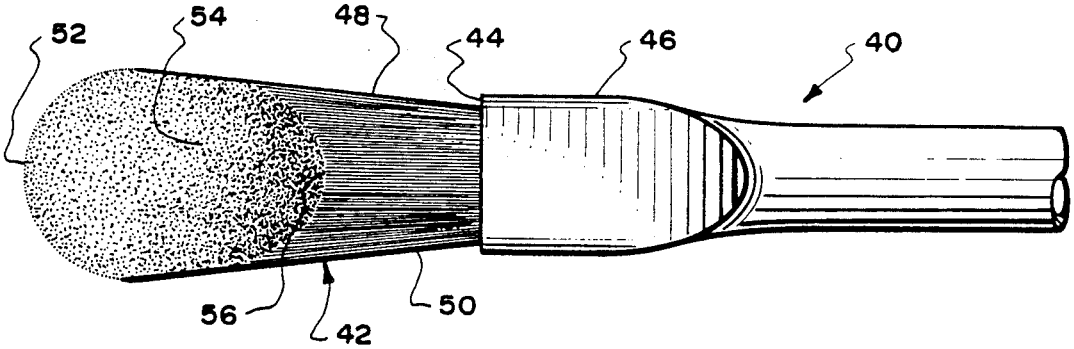
FIG. 7 is a bottom plan view of the second embodiment of the improved nail polish brush of the present invention.
Figure 8:
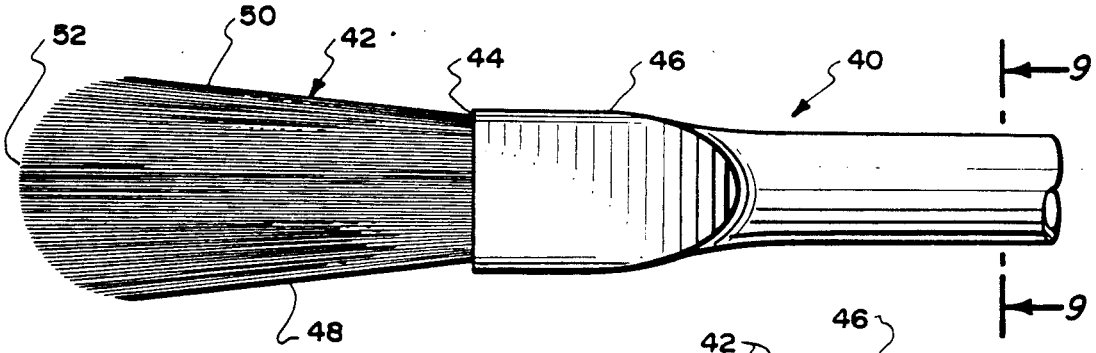
FIG. 8 is a top plan view of the second embodiment of the improved nail polish brush of this invention.
Figure 9:
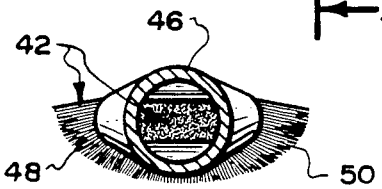
FIG. 9 is a cross-sectional view through the handle of the second embodiment of the improved nail polish brush of the present invention taken along line 9—9 of FIG. 8.

A tapered and contoured brush for applying fluid material such as nail polish to nail surfaces of a user is described. In the following description, numerous specific details, such as dimension ranges, are described in order to provide a more thorough understanding of the present invention. It will be obvious to one skilled in the art, that the present invention may be practiced without these specific details.

The tapered, contoured, and curved bristle configuration of the present invention enables the user to provide a uniform concentration of the paint or polish to the nail surface without depositing material in the surrounding cuticles, collecting at the lower nail base, or accumulating on the bristle fibers. Additionally, the bristles readily yield and bend laterally to prevent streaking of the applied polish.

Referring to FIGS. 1 to 5, there is shown the first embodiment 10 of the present invention. Embodiment 10 is comprised of two primary elements, a handle 12 and a bristle body 14. The handle 12 may be of any desired shape or size. It has been found most desirable to construct the handle 12 small enough to fit within a polish bottle (not shown) and integral with a cap for sealing the bottle. The handle 12 may be constructed from any rigid material capable of withstanding continuous contact with paint solvents. At the present time the most widely used material is plastic. The advantage of utilizing plastic is that it is easily molded and thus a handle having a plurality of shapes and configuration may be provided. Additionally, the splintering, shaving, and decomposition of wooden materials may be avoided.

The bristle body 14 is fixedly mounted within a narrowed opening 16 of the handle 12. Basically, the portion of the handle 12 at the opening 16 is merely tightly clamped onto the bristle body 14. Bristle body 14 is composed of fibers of nylon, plastic or other material having properties of resiliency, flexibility and sufficient stiffness to maintain shape to withstand constant contact with paint solvents. It is the proximate edge 18 of the bristle body 14 that is mounted within narrowed opening 16.

The bristle body 14 has an outer free edge defined as a distal edge 20. It is noted that the distal edge 20 is arcuate. The bristles within the bristle body 14 are arranged so that the longest bristles are located in the center area of the bristle body 14 and as the bristles get closer to the side edges 22 and 24 of the bristle body 14, the bristles become shorter in length. Normally, it is preferred that the length of the bristle body 14 be one and one-half times the width of the body 14. The arcuate shape of the distal edge 20 is to substantially correspond to the contoured shape of the cuticle area of a user's finger nail.

In the first embodiment shown in FIGS. 1 to 5, the thickness of the bristle body 14 is approximately three times that of regular brushes currently available on the market. The thickness at the distal edge 20 is approximately one-third the thickness of the proximate edge 18. The inferior surface 26 is formed into a pronounced ledge 28 at approximately three-eighths of the length of the bristle body 14 from the proximate edge 18. From the ledge 28, the inferior surface of the bristle body 14 is defined by a smooth planar tapered surface 30. This tapered surface 30 begins at the ledge 28 and extends all the way to the distal edge 20.

One of the reasons for the ledge 28 is to help assist in the transmission of the liquid so that accumulations at the proximate edge 18 are diminished. The ledge 28 also helps contain the polish within the outer area of the bristle body 14 so that it can be applied onto the surface of the nail. As the bristle body 14 is pressed against the surface of the nail it will expand laterally and is intended to completely cover the surface of the nail. Therefore, when the user makes one movement in tending to apply the polish to the nail that an even coat of polish is to be applied to the nail in the performing of this single movement.

Figure 10:
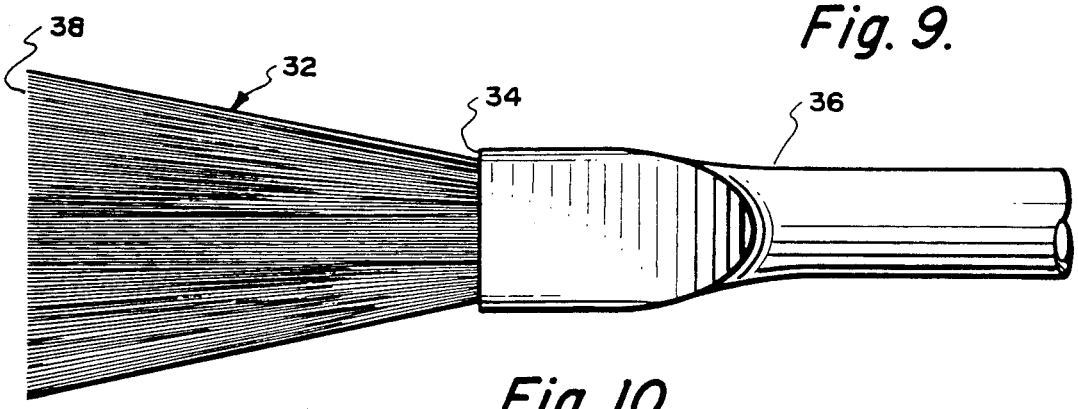
FIG. 10 is a top plan view showing a modified form of improved nail polish brush of the present invention where this modification could be incorporated within either the first or second embodiment of the improved nail polish brush of this invention.

Constructing of the bristle body 14 to be used primarily on toe nails rather than finger nails may require constructing the bristle body 14 as shown as bristle body 32 within FIG. 10. Bristle body 32 has a proximate end 34 which is fixedly mounted to a handle 36. The distal edge 38 of the bristle body 32 is shown not to be arcuate but has a planar configuration.

Referring particularly to the second embodiment 40 of this invention, there is a bristle body 42, the proximate end 44 of which is fixedly mounted to the handle 46. Bristle body 42 has side edges 48 and 50 and a distal edge 52.

The primary difference of the embodiment in FIGS. 6 through 9 as opposed to the first embodiment in FIGS. 1 through 5, is that the inferior surface includes an arcuate recess 54. This arcuate recess 54 ends up producing a ledge 56 which is in essence similar to the ledge 28. The ledge 56 is for the same purpose as ledge 28. This construction of the inferior surface 54 is to facilitate the even lateral spreading out of the bristle body 42 as it is pressed onto the surface of the nail. Also, this shape of inferior surface 54 facilitates again even application of the liquid onto the surface of the nail. The construction of the recess 54 produces an angle A in the range of fifteen to thirty-five degrees with the remaining portion of the inferior surface of the bristle body 42.

The tapered, contoured, and curved brush configuration disclosed in the present invention enable the user to minimize the streaking and staining of the surrounding cuticle regions which has plagued paint and polish users to date. This is accomplished by virtue of the tapering effect which prevents a large concentration of liquid from collecting at the distal edge of the brush. Instead, liquid is spread evenly along the tapering edges. The contoured edges and curved bristles which are wider and shorter than the prototypes currently available, enable the user to apply paint or polish more quickly and satisfactorily by conforming to the shape of the nail and preventing placement of the paint to surrounding cuticle surfaces. Thus, it may be seen that a useful and effective brush has been described.

What is claimed is:

1. An improved nail polish brush comprising:

an elongated handle, said handle terminating in a pair of ends;

a bristle body having a proximate edge, said proximate edge being fixedly secured to said handle at a said end, said bristle body extending outward from said end defining a distal edge, said bristle body being formed of a mass of bristles, said bristle body also having an inferior surface adapted to be placed in contact with a nail on which polish is to be applied, the improvement comprising:

said bristles assuming a variety of different lengths, said inferior surface defining a ledge, said ledge defining a surface located transverse to the longitudinal axis of each of said bristles, whereby said ledge functions to locate the polish in the outer portion of said bristle body decreasing the accumulation of polish at said proximate edge.

2. The improved nail polish brush as defined in claim 1 wherein:

said distal edge being wider than said proximate edge.

3. The improved nail polish brush as defined in claim 2 wherein:

said ledge being located approximately three-eighths of the length of said bristle body from said proximate edge.

4. The improved nail polish brush as defined in claim 3 wherein:

the portion of said bristle body at said proximate edge being of a thickness approximately three times than the portion of said bristle body at said distal edge.

5. The improved nail polish brush as defined in claim 4 wherein:

said inferior surface being substantially planar between said distal edge and said ledge.

6. The improved nail polish brush as defined in claim 4 wherein:

said inferior surface being concavely arcuate between said distal edge and said ledge.

* * * * *